US012637259B2

(12) United States Patent
Rognard

(10) Patent No.: US 12,637,259 B2
(45) Date of Patent: May 26, 2026

(54) CLOSURE

(71) Applicant: OBRIST CLOSURES SWITZERLAND GMBH, Muttenz (CH)

(72) Inventor: Jean-Yves Rognard, Saint-Georges-de-Reneins (FR)

(73) Assignee: OBRIST CLOSURES SWITZERLAND GMBH, Muttenz (CH)

( * ) Notice: Subject to any disclaimer, the term of this patent is extended or adjusted under 35 U.S.C. 154(b) by 6 days.

(21) Appl. No.: 18/718,292

(22) PCT Filed: Dec. 11, 2022

(86) PCT No.: PCT/EP2022/085271

§ 371 (c)(1),
(2) Date: Jun. 10, 2024

(87) PCT Pub. No.: WO2023/110693

PCT Pub. Date: Jun. 22, 2023

(65) Prior Publication Data

US 2025/0051061 A1 Feb. 13, 2025

(30) Foreign Application Priority Data

Dec. 16, 2021 (GB) ..... 2118303

(51) Int. Cl.

| | |
|---|---|
| ***B65D 41/46*** | (2006.01) |
| ***B65D 47/08*** | (2006.01) |
| ***B65D 55/16*** | (2006.01) |

(52) U.S. Cl.

CPC ..... *B65D 41/46* (2013.01); *B65D 47/0804* (2013.01); *B65D 55/16* (2013.01); *B65D 2401/30* (2020.05); *B65D 2547/066* (2013.01)

(58) Field of Classification Search

CPC .... B65D 41/46; B65D 47/0804; B65D 55/16; B65D 2401/30; B65D 2547/066;
(Continued)

(56) References Cited

U.S. PATENT DOCUMENTS 6,405,885 B1 * 6/2002 Elliott ..... B65D 47/0838 222/541.9
2008/0169261 A1 7/2008 Druitt et al.
(Continued)

FOREIGN PATENT DOCUMENTS

EP 1124734 B1 7/2002
GB 2430667 4/2007
(Continued)

OTHER PUBLICATIONS

International Search Report and Written Opinion for PCT/EP2022/085271 dated Mar. 29, 2023.
(Continued)

*Primary Examiner* — James N Smalley
(74) *Attorney, Agent, or Firm* — Barnes & Thornburg LLP

(57) ABSTRACT

A tamper-evident closure (1) is provided and comprises a base (10) and a lid (50). The base comprises a sidewall (14) and an outer wall (30*a*) which is radially outwards of the sidewall. The closure comprises a tamper-evident member (56) which is initially frangibly attached to the lid. Upon first opening of the lid the tamper-evident member is released from the lid and falls between the sidewall and the outer wall.

23 Claims, 12 Drawing Sheets

(58) Field of Classification Search
CPC .... B65D 2251/1033; B65D 2251/1066; B65D 2401/20; B65D 2401/45; B65D 47/0842
See application file for complete search history.

(56) References Cited

U.S. PATENT DOCUMENTS

| | | | | |
|---|---|---|---|---|
| 2009/0152269 | A1 | 6/2009 | Pucci | |
| 2012/0067922 | A1* | 3/2012 | Benoit-Gonin | B65D 55/024 222/546 |
| 2014/0138380 | A1* | 5/2014 | Fox | B65D 51/24 220/214 |
| 2019/0119008 | A1* | 4/2019 | Berroa Garcia | B65D 41/32 |
| 2021/0261308 | A1 | 8/2021 | Ferrari | |

FOREIGN PATENT DOCUMENTS

| | | | |
|---|---|---|---|
| GB | 2430667 | A | 4/2007 |
| WO | 2012131097 | | 10/2012 |
| WO | 2012131097 | A1 | 10/2012 |
| WO | 2021116468 | A1 | 6/2021 |

OTHER PUBLICATIONS

International Preliminary Report on Patentability for PCT/EP2022/085271 dated Feb. 16, 2024, 14 pages.
Written Opinion of the International Preliminary Examining Authority for PCT/EP2022/085271 dated Mar. 11, 2023, 14 pages.
International Search Report and Written Opinion for PCT/EP2022/085271 dated Apr. 11, 2023, 13 pages.
Extended European Search Report for Priority European Patent App. No. EP2519778.7 mailed May 26, 2025, 8 pages.

* cited by examiner

CLOSURE

CROSS REFERENCE TO RELATED APPLICATIONS

This application is a U.S. national stage application under 35 U.S.C. § 371(b) of International Application No. PCT/EP2022/085271, filed Dec. 11, 2022, which claims priority to the United Kingdom Patent Application No. 2118303.3 filed on Dec. 16, 2021, the disclosures of both of which are hereby expressly incorporated by reference in their entirety.

The present invention relates generally to a closure, and particularly, although not exclusively, to a tamper-evident dispensing closure.

Closures for containers are used for a variety of purposes. In many cases it is desirable to know if the closure has been previously opened, particularly, for example, if the user wishes to verify that the contents of a container have not been accessed.

The present invention seeks to provide improvements in or relating to closures.

An aspect of the present invention provides a tamper-evident closure comprising a base and a lid, the base comprises a sidewall, the base further comprises an outer wall which is radially outwards of the sidewall, the closure comprises a tamper-evident member which is initially frangibly attached to the lid, in which upon first opening of the lid the tamper-evident member is released from the lid and falls between the sidewall and the outer wall.

In some embodiments, in the initially unopened position at least part of a tamper-evident member is hidden from view. The member may be at least partly hidden by the outer wall.

In some embodiments, upon first opening at least part of a tamper-evident member becomes visible.

In some embodiments, in the initially unopened condition the tamper-evident member is hidden and upon first opening of the lid it becomes visible.

The tamper-evident member may be connected to the free end of a lid side skirt.

The tamper-evident member may engage with outer wall to cause release upon first opening.

The outer wall may include a window in which or through which the member can be seen after first opening. The window may, for example, be formed as a slot, slit, hole or the like. In some embodiments the window extends through the thickness of the outer wall. In other embodiments the window is formed as a material thinning or from a different material.

The outer wall may extend from the sidewall. For example the sidewall and the outer wall form a bifurcation (in section) at one end of the base.

The base may include a top deck and the sidewall may depend from the periphery thereof.

The outer wall may be formed as an open valley, for example a wall into which a tamper-evident member can fall and be retained.

The sidewall may be generally cylindrical and the outer wall may be formed concentrically therewith.

In some embodiments one or more outer wall portions are provided that extend partially around the sidewall. For example one or two outer wall portions may be provided (which may be diametrically opposite each other). In other embodiments a single wall portion extends all of the way around a sidewall.

The base and lid may be joined by a hinge so that the lid can move between a closed and an open position. In some embodiments the hinge is formed as a strap connected at or towards one end to the lid and at or towards its other end to the base.

The tamper-evident member may formed as a drop tab.

In some embodiments a plurality of tamper-evident members are provided, for example two, three or four. In some embodiments multiple members are provided so as to appear in the same outer wall portion; in some embodiments multiple outer wall portions are provided and one or more member becomes visible in each portion.

In some embodiments the closure is formed as a mono-piece and may be mono-material.

The lid includes a hook, projection or the like for engaging the base. Part of the lid may be movable to disengage the hook. The hook may be configured to increase dynamic sealing of the lid onto the base.

The base may include a screw thread formation for engaging a container. Alternatively or additionally the base may include a snap bead for engaging a container. Snap-on and screw-on versions may be provided.

The closure may be formed as a tethered closure. The base may comprise a retaining ring for retaining the closure on a container, the base may include a tether between the retaining ring and the sidewall.

In some embodiments the sidewall and the outer wall may terminate at approximately the same axial level. The outer wall may therefore not extend above the top deck of a base.

The base may comprise a dispensing spout. The spout may be formed integrally with the base.

The spout may be eccentrically positioned on the base. For example the base and the lid may be connected at a rear of the closure by a hinge and the spout may be positioned towards a front of the closure.

In some embodiments the spout has a height of between 6 mm and 10 mm, for example approximately 8 mm.

In some embodiments a tamper-evident member is provided at either or both sides of the closure. Other positions for a tamper-evident member, such as the front, may be included.

A further aspect of the present invention provides a flip-top, tamper-evident dispensing closure comprising a base and a lid joined by a hinge, the base comprises a top deck and sidewall depending therefrom, the base further comprises an outer wall portion which is outboard of the sidewall, the closure comprises a tamper-evident drop tab, in which upon first opening of the lid the tamper-evident member falls to become visible in the outer wall portion.

A further aspect provides a tamper-evident closure comprising a base and a lid, the base comprises a sidewall, the base further comprises an outer wall which is radially outwards of the sidewall, the closure comprises a tamper-evident member which is hidden in an initially unopened condition and upon first opening of the lid becomes visible in or through the outer wall.

A further aspect provides a mono-piece tamper-evident dispending closure comprising a base and a lid, the base comprises a top deck and a sidewall, the base includes an integral dispensing spout, the base comprises one or more double wall portions, the closure comprises a tamper-evident member which upon first opening of the lid falls into or further into the double wall portion.

Aspects and embodiments may include or provide one or more of the following features/benefits:

radial TE
double wall
radial double wall
eccentric spout drop tab visible after first opening the drop tab is hidden and then becomes visible after first opening.

more convenience for drinking.

no sharp edges hinge conforms with child safety rules EN7I possible to use a chuck for capping application.

external radial TE drop tab.

Mono-piece and/or mono-material closures may be provided. Closures may be formed from plastics material, for example poly propylene or polyethylene. Closures may be formed by injection moulding. Bi-injection moulding may be used.

The present invention also provides a closure as described herein in combination with a container.

Different aspects and embodiments of the invention may be used separately or together.

Further particular and preferred aspects of the present invention are set out in the accompanying independent and dependent claims. Features of the dependent claims may be combined with the features of the independent claims as appropriate, and in combination other than those explicitly set out in the claims. Each aspect can be carried out independently of the other aspects or in combination with one or more of the other aspects.

The present invention will now be more particularly described, by way of example, with reference to the accompanying drawings, in which.

Figure 1B:
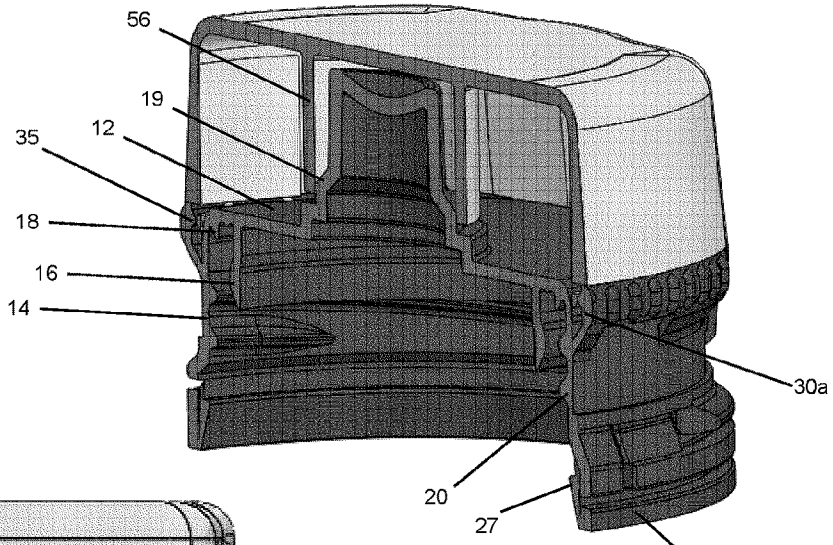
FIG. 1B is a section of the closure of FIG. 1A.
Figure 1C:
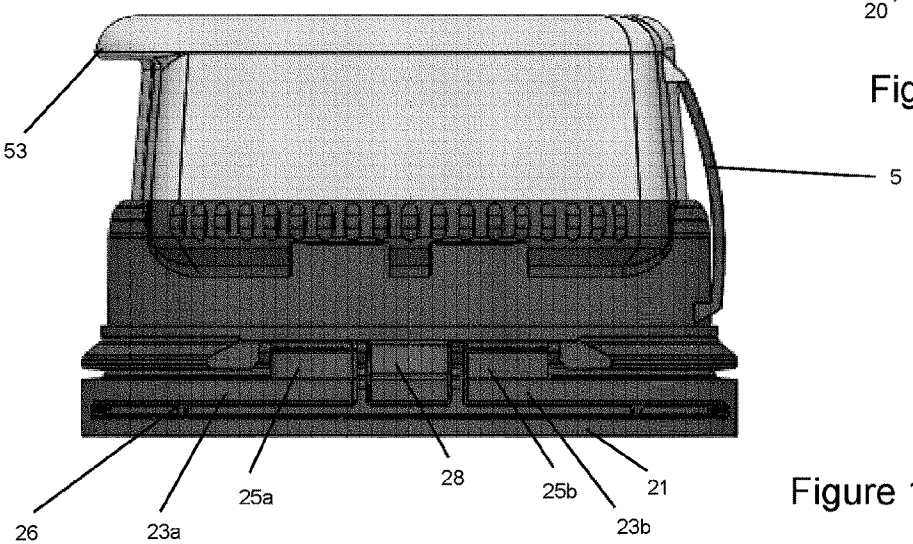
FIG. 1C is a side view of the closure of FIG. 1A.
Figure 1A:
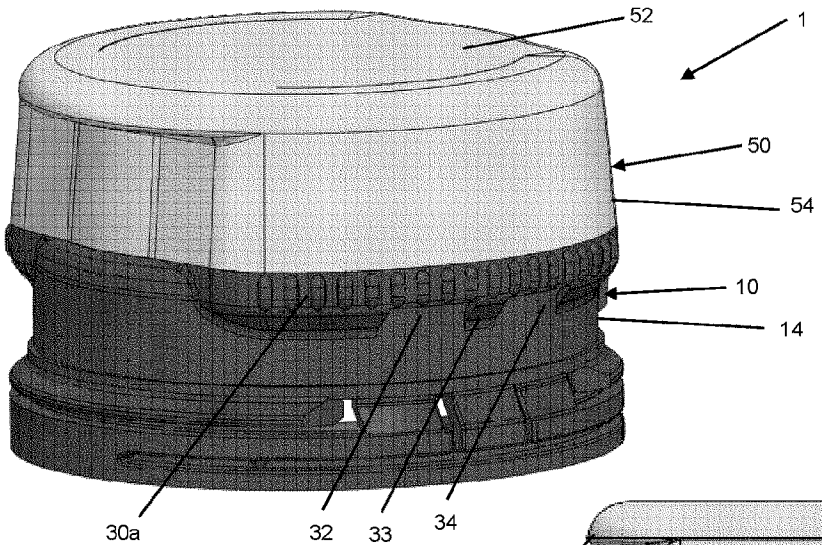
FIG. 1A is a perspective view of a closure formed according to an embodiment of the present invention and shown in an unopened condition.
Figure 2B:
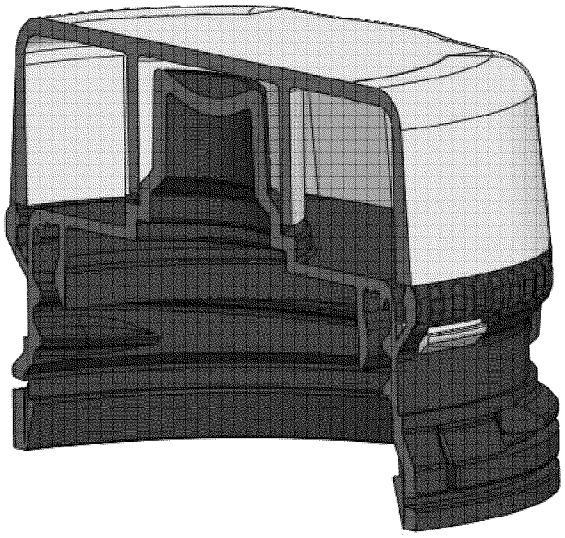
FIG. 2B shows the closure of FIG. 1B in an opened position.
Figure 2C:
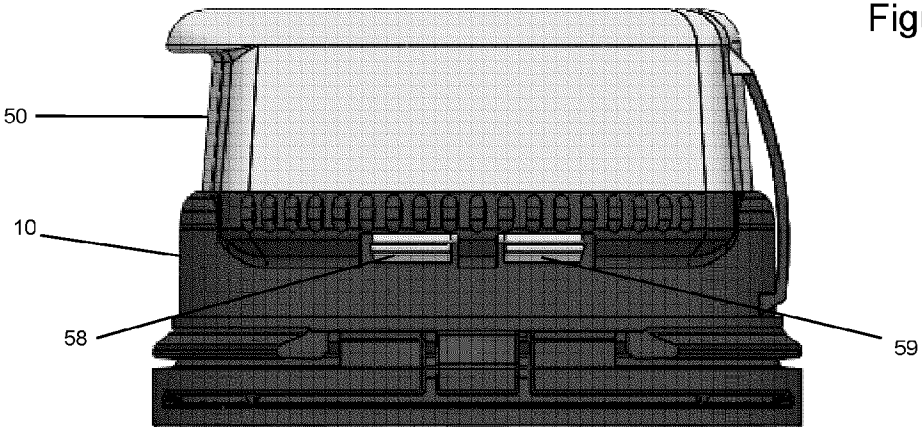
FIG. 2C shows the closure of FIG. 1C in an opened position.
Figure 2A:
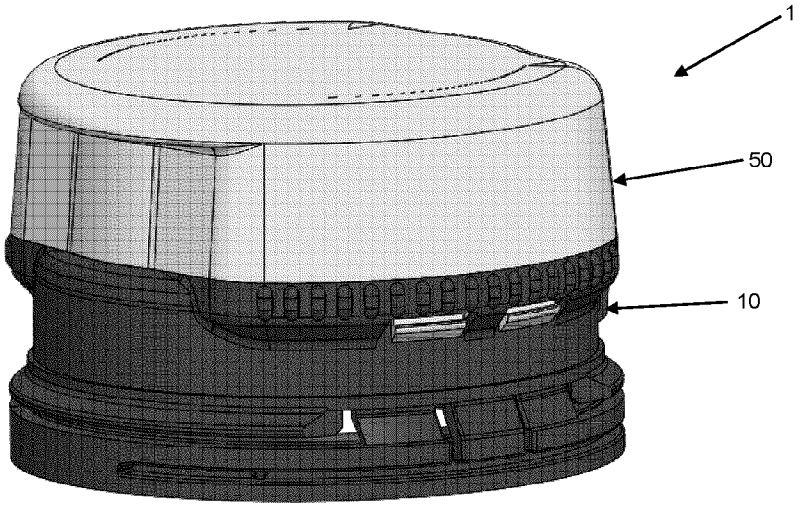
FIG. 2A is a perspective view of the closure of FIG. 1A shown in an opened position.
Figure 3B:
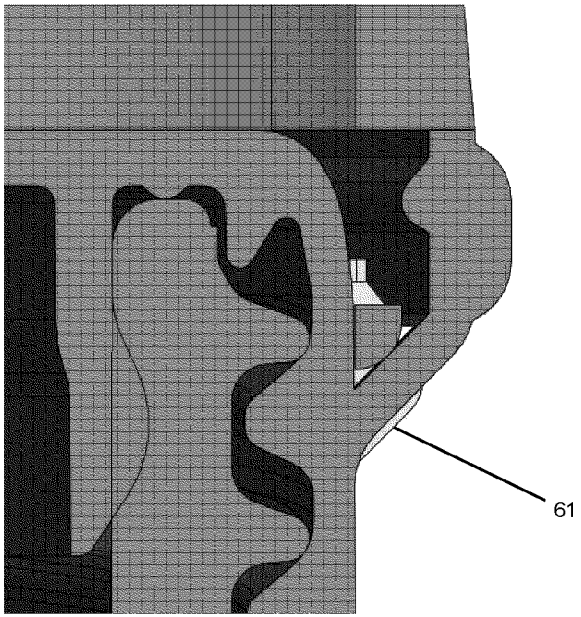
FIG. 3B illustrates the view of FIG. 3A following first opening.
Figure 3A:
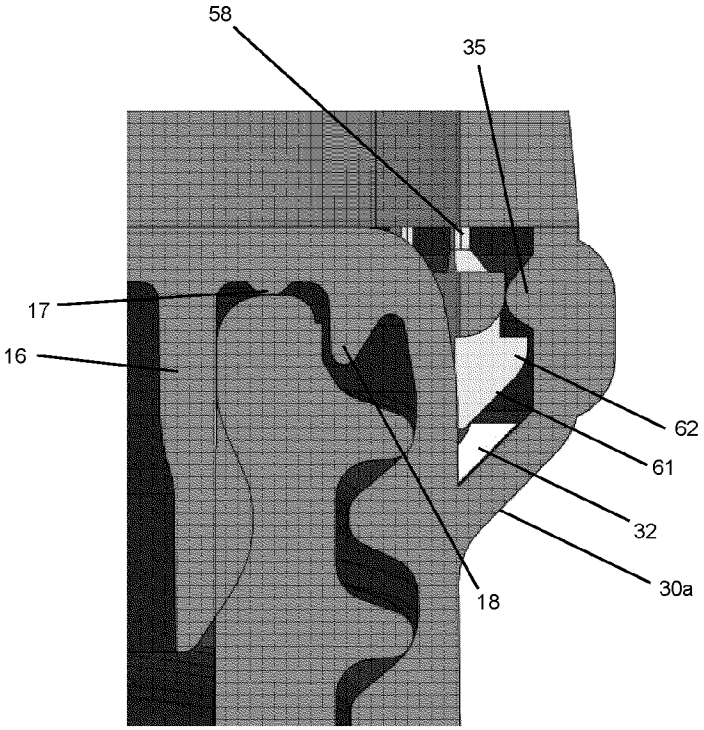
FIG. 3A is a magnified sectional view of the closure of FIG. 1A in the region of a tamper-evidencing double wall portion.

The example embodiments are described in sufficient detail to enable those of ordinary skill in the art to embody and implement the systems and processes herein described. It is important to understand that embodiments can be provided in many alternative forms and should not be construed as limited to the examples set forth herein.

Accordingly, while embodiments can be modified in various ways and take on various alternative forms, specific embodiments thereof are shown in the drawings and described in detail below as examples. There is no intent to limit to the particular forms disclosed. On the contrary, all modifications, equivalents, and alternatives falling within the scope of the appended claims should be included. Elements of the example embodiments are consistently denoted by the same reference numerals throughout the drawings and detailed description where appropriate.

Unless otherwise defined, all terms (including technical and scientific terms) used herein are to be interpreted as is customary in the art. It will be further understood that terms in common usage should also be interpreted as is customary in the relevant art and not in an idealised or overly formal sense unless expressly so defined herein.

In the following description, all orientational terms, such as upper, lower, radially and axially, are used in relation to the drawings and should not be interpreted as limiting on the invention.

Referring first to FIGS. 1 to 7 there is shown a tamper-evident closure generally indicated 1.

The closure 1 comprises a base 10 and a lid 50 joined by a hinge 5.

In this embodiment the hinge 5 is a strap that is connected at one end to the lid and at the other end to the base. The strap is wider at its end connecting to the base and narrower at is end connecting to the lid, providing a generally trapezoidal shape (see FIG. 4C, for example).

The base 10 comprises a generally circular top deck 12 and a generally cylindrical sidewall 14 depending from the periphery of the top deck.

An annular inner seal 16 depends from the underside of the top deck. An annular outer seal 18 depends from the intersection between the top deck and the sidewall. An annular top seal bead 17 depends from the underside of the top deck between the inner 16 and outer 18 seals.

A spout 19 upstands from the top deck. In this embodiment the spout is located eccentrically (see FIGS. 4A to 4C, for example) towards a "front" of the base, opposite the hinge.

A screw thread formation 20 is provided on the interior surface of the sidewall 14.

At either side of the base a double wall arrangement is provided. Towards the top deck end of the sidewall a radial wall portion 30*a*, 30*b* extends radially outwards to form a gully/valley. Each radial wall portion includes two (in this embodiment) windows 32, 34 separated by a central wall 33. The interior of the wall portions 30*a*, 30*b* is provided with an internal retention bead 35.

The base includes a tethering arrangement at its free end (opposite the top deck).

The tethering arrangement comprises a ring retaining part 21, two arms 23*a*, 23*b*, two film hinges 25*a*, 25*b*.

A plurality of upturned retaining flaps 27 are provided on the interior of the retaining ring and extend radially inwardly and upwardly.

Each arm 23*a*, 23*b* has the shape of an arc of a circle and is connected to the sidewall 186 on the one hand, at the level of one of the film hinges 25*a*, 25*b*, and to the ring part 21 on the other hand. Along the upper and lower edge of the arms there are frangible bridges 26.

Each arm 23*a*, 23*b* is connected to the ring part 21 at a location which is angularly distant with respect to the film hinges 25*a*, 25*b* to which it is connected, the angle formed by this location and this film hinge being, in the example shown, of the order of 45 to 50 degrees.

The film hinges 25*a*, 25*b* comprise walls of reduced thickness, of generally rectangular shape, connected to the sidewall wall of the cap part on the one hand and to respective arms 23*a*, 23*b* on the other hand.

The flexibility which allows the tilting of the closure cap in use is obtained partly by means of this hinge shape and by the arrangement in the cap part 386.

A tongue 28 depends axially from the sidewall between the two inclined film hinges 25*a*, 25*b*. The hinges 25*a*, 25*b* are symmetrical with respect to the median axis of the tongue 28.

The retaining arrangement is provided so that the closure cannot be completely removed from a container in use.

In practice, the closure is placed on a container by simple screwing. Normal operation of the closure is as a flip-top dispensing closure by opening and closing the lid. However, if the sidewall is unscrewed the cap part progressively leaves its position which is axially close to the ring 21 until it reaches a position which is axially remote from this ring 21, in which the helical threads of the container and of the cap are out of engagement. The frangible bridges 26 rupture during this movement and the arms 23*a*, 23*b* pass from their folded position to the unfolded position shown in by pivoting. The cap may be tilted by virtue of the film hinges 25*a*, 25*b* and by rolling and deformation of the tongue 28 against the container neck.

In this embodiment the tongue 28 has a length such that, during tilting of the cap it bears against the container and exerts, via this bearing, a pulling on the arms 23*a*, 23*b*. This pulling is non-existent in the positions of engagement of the cap over the opening of the container and of full release of this cap beyond this opening, but is maximal, the tongue 28 then being flexed, in the intermediate position of the cap between these two positions.

Other types of tethering arrangement, for example a lasso, are possible.

The lid 50 comprises a top plate 52 and a depending side skirt 54. A sealing skirt 56 depends from the underside of the top plate. A peak 53 is provided by the lid.

At the free end of the side skirt 54 a tamper-evident member 56 is frangibly connected via frangible bridges 57. The member 56 includes two tabs 58, 59 separated by a central notch 60. Each tab 58, 59 includes an inclined front face 61 and a hook 62.

Figure 4A:
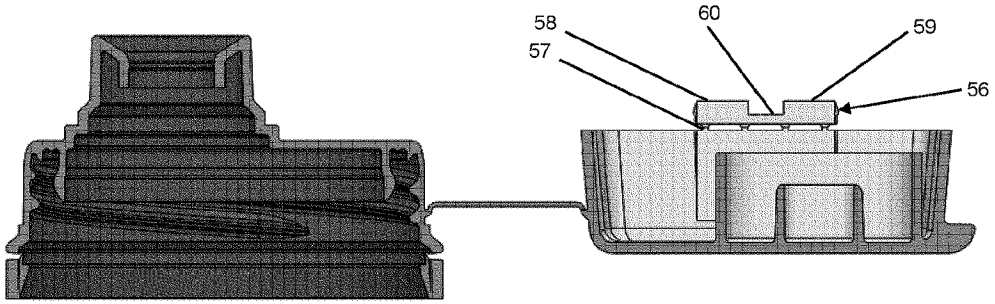
FIGS. 4A to 4C show sectional, perspective and plan views of the closure in an as-moulded condition.
Figure 4C:
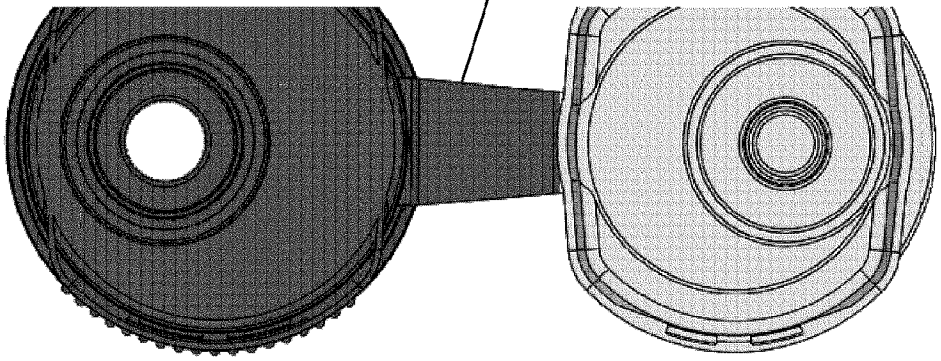
Figure 4B:
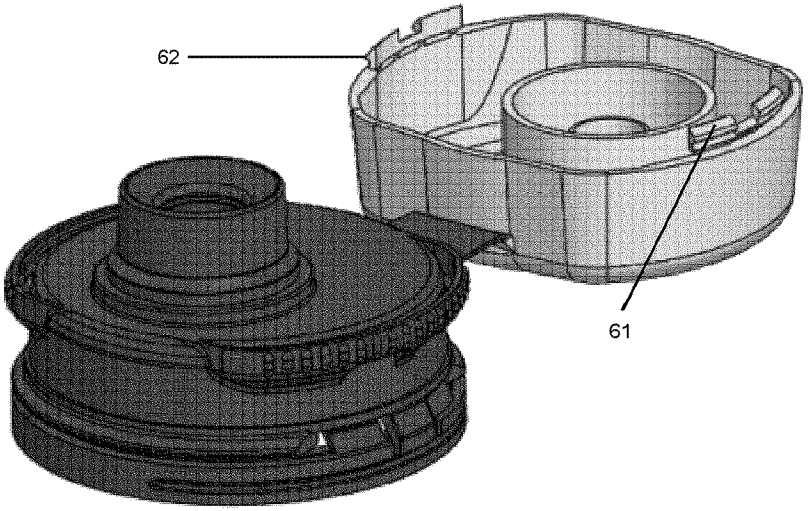
Figure 5B:
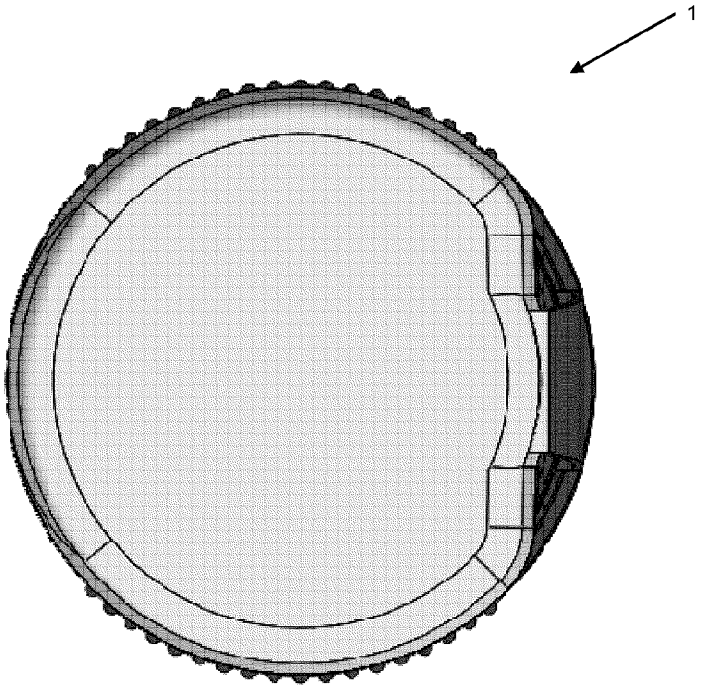
FIGS. 5A to 5D show perspective, plan and sectional views of the closure upon first closing and shown attached to a container neck.
Figure 5A:
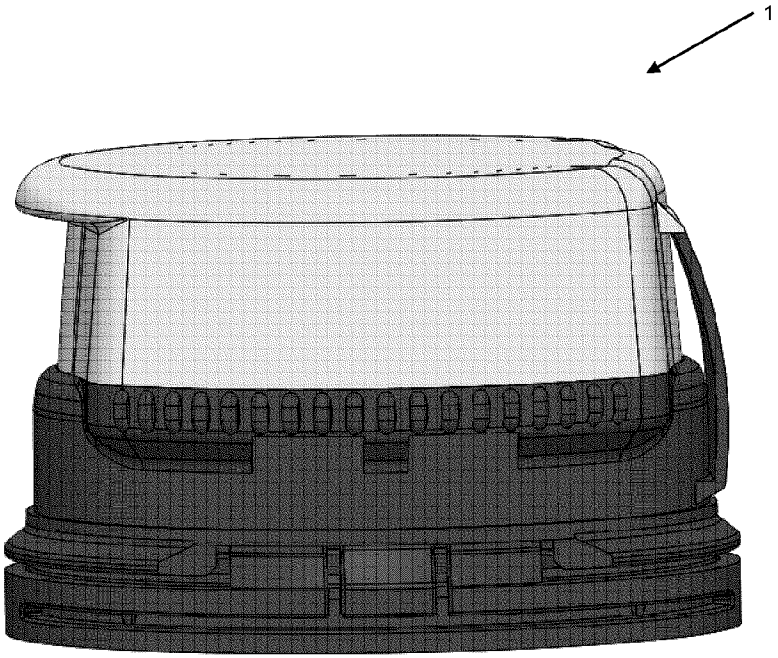
Figure 5D:
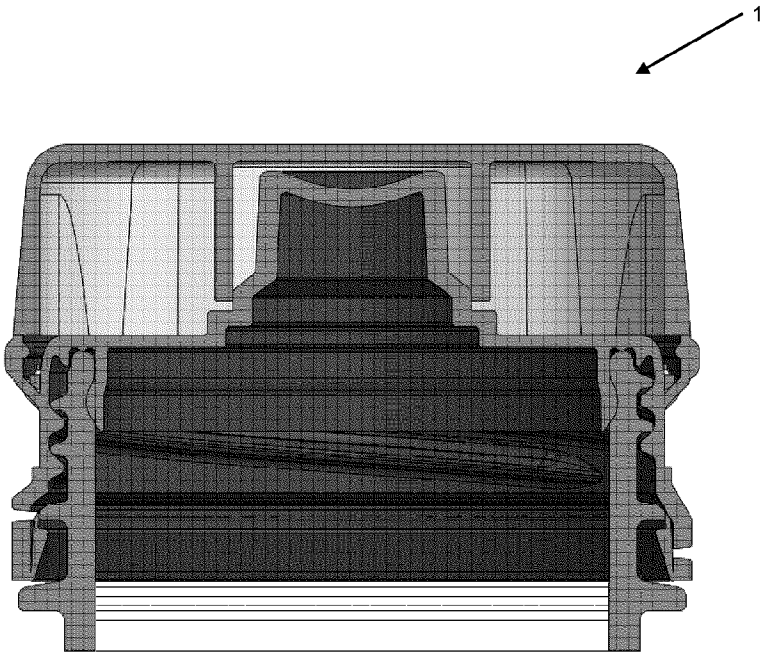
Figure 5C:
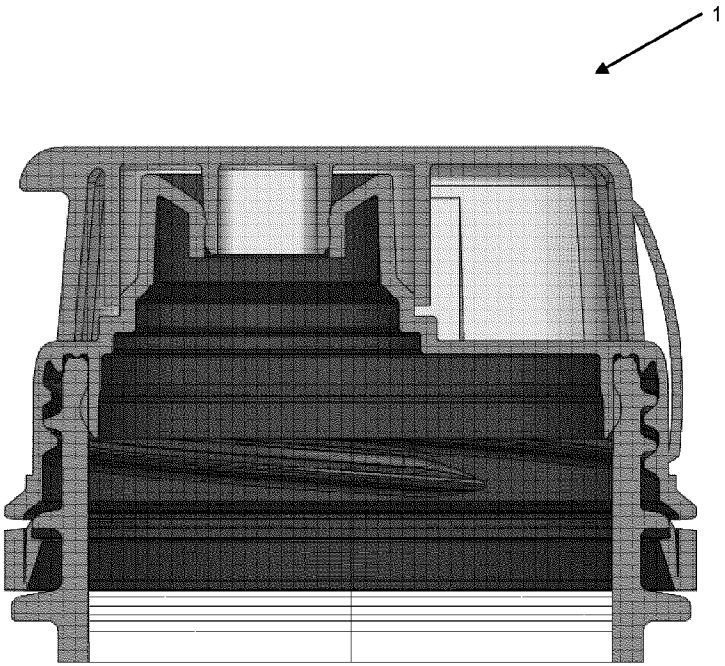

In this embodiment the closure is formed (for example by injection moulding of a plastics material such as polypropylene or polyethylene) with the lid in an open position as shown in FIGS. 4A-4C. Demoulding may be achieved using sliders.

The lid is initially closed onto the base. In some embodiments an in-mould closing operation is used to close the lid. Closing the lid causes the tamper-evident members to enter into space between the sidewall and the radial wall portions at each side of the closure. The hooks 62 of the tabs 58, 59 are caused to pass under the wall portion retention beads 35—see FIG. 3A, for example. The tamper-evident member 56 is not visible in the initially closed position.

In order to use the closure the lid 50 is lifted using the peak 53. The tab hooks 62 cannot pass back over the beads 35 and this causes the frangible bridges 57 to rupture. The tamper-evident member 56 then drops down further into the space between the sidewall and the radial wall portion until the notch 60 rests on the central wall 33; in doing so the tabs 58, 58 appears in the windows 32, 34—see FIG. 3B, for example. This provides visual evidence that the lid has been opened.

Figure 6B:
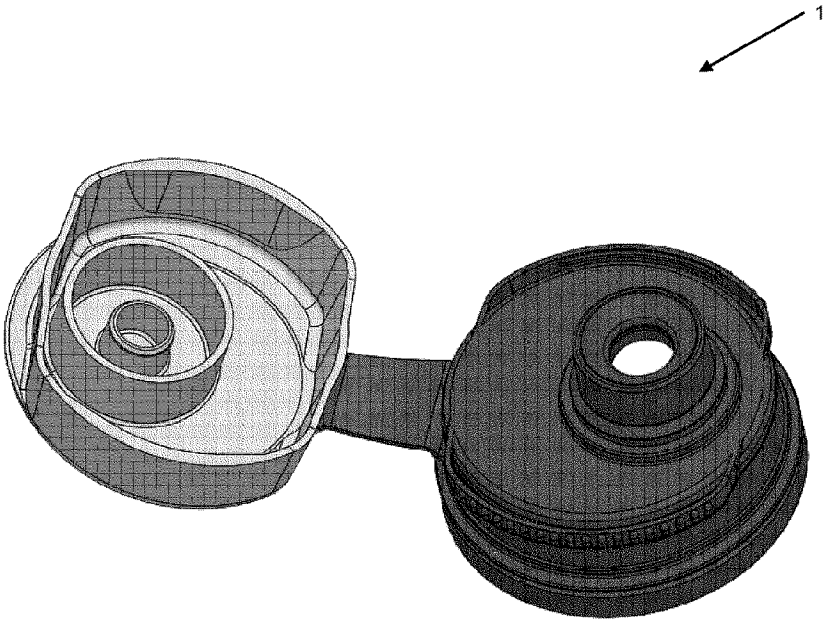
FIGS. 6A and 6B show the closure following opening of the lid.
Figure 6A:
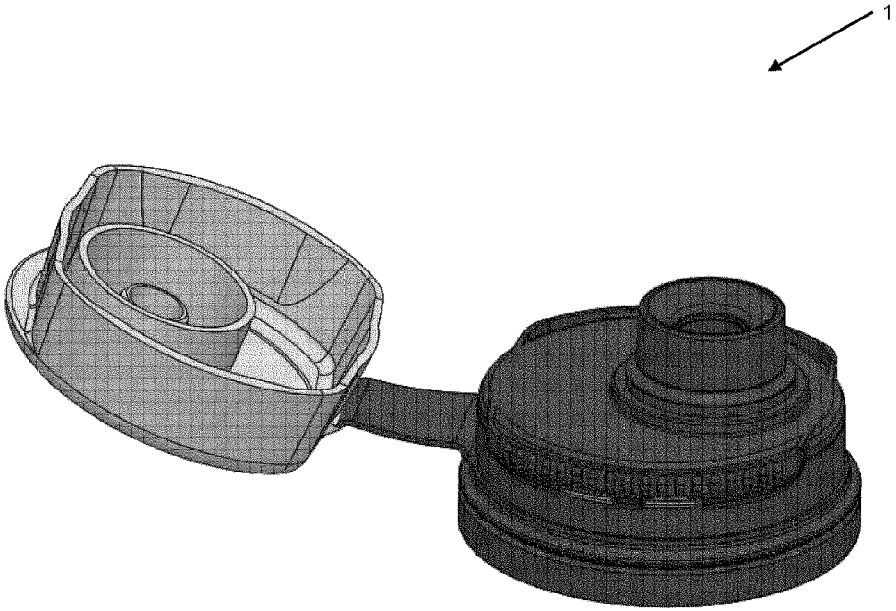
Figure 7:
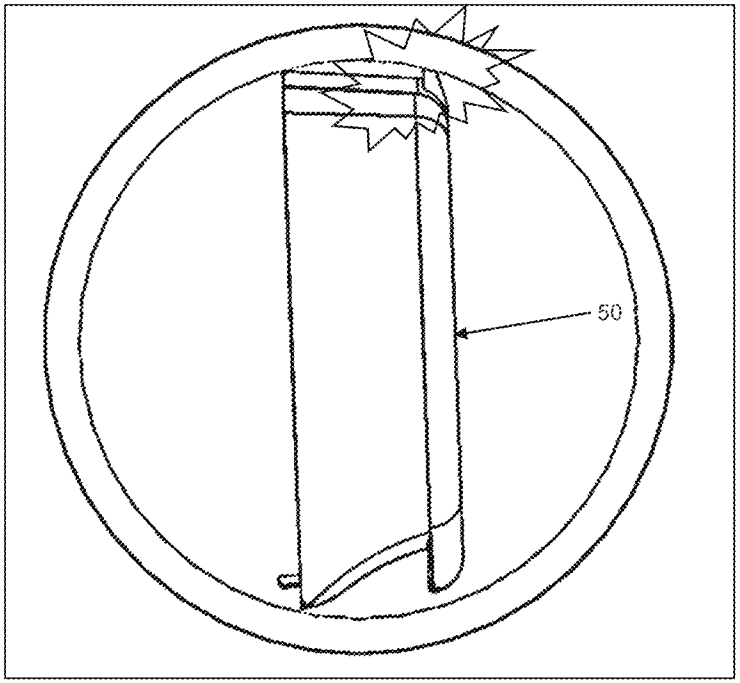
FIG. 7 illustrates conformation of the closure lid with safety rules.

FIGS. 6A and 6B show the closure in an open position, with the tamper-evidence activated. The spout is shown located away from the hinge and this makes it easier to drink directly therefrom.

The closure conforms with child safety rules EN7I. The lid doesn't fall down into cylinder 31.7 mm (see FIG. 7).

Figure 8:
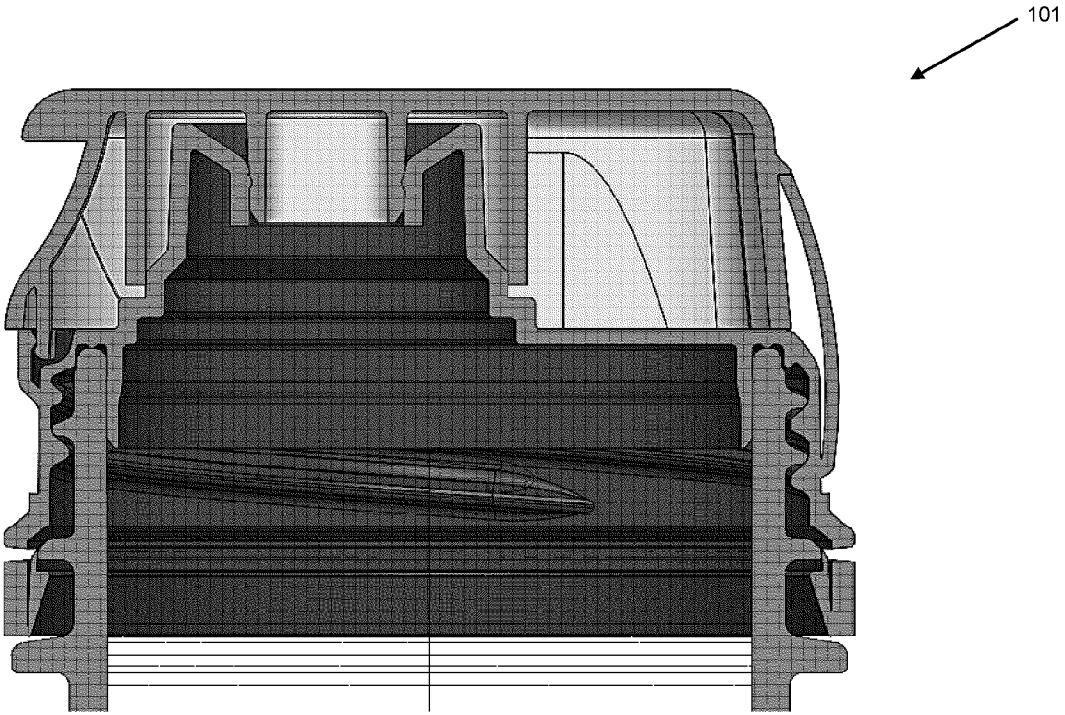
FIGS. 8 to 10 show a closure formed according to a further embodiment.
Figure 10:
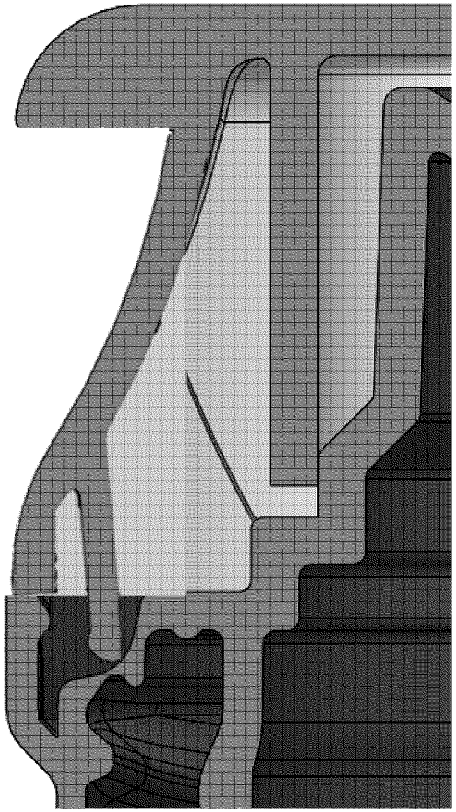
Figure 9:
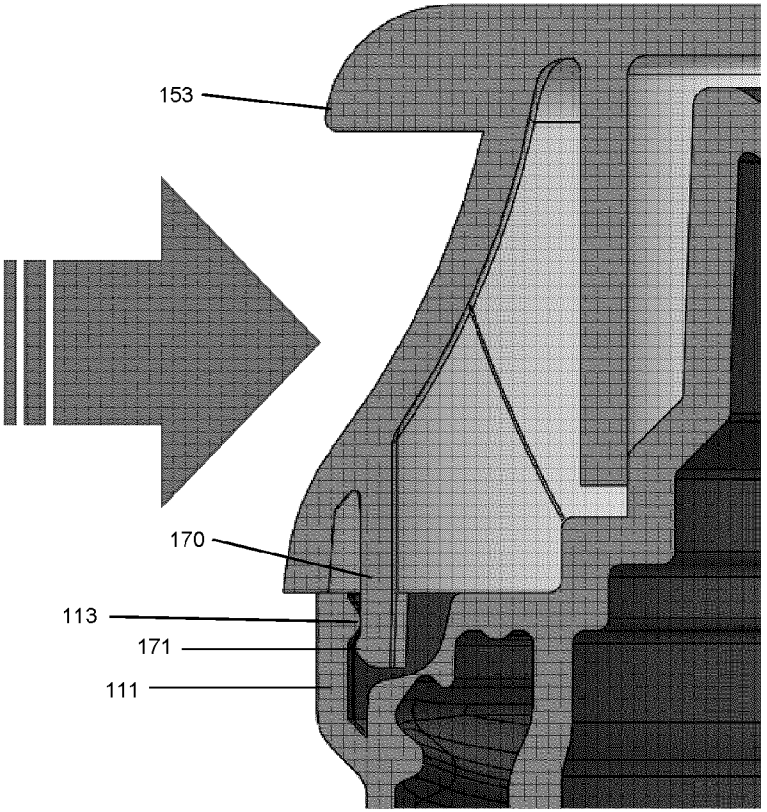
Figure 11:
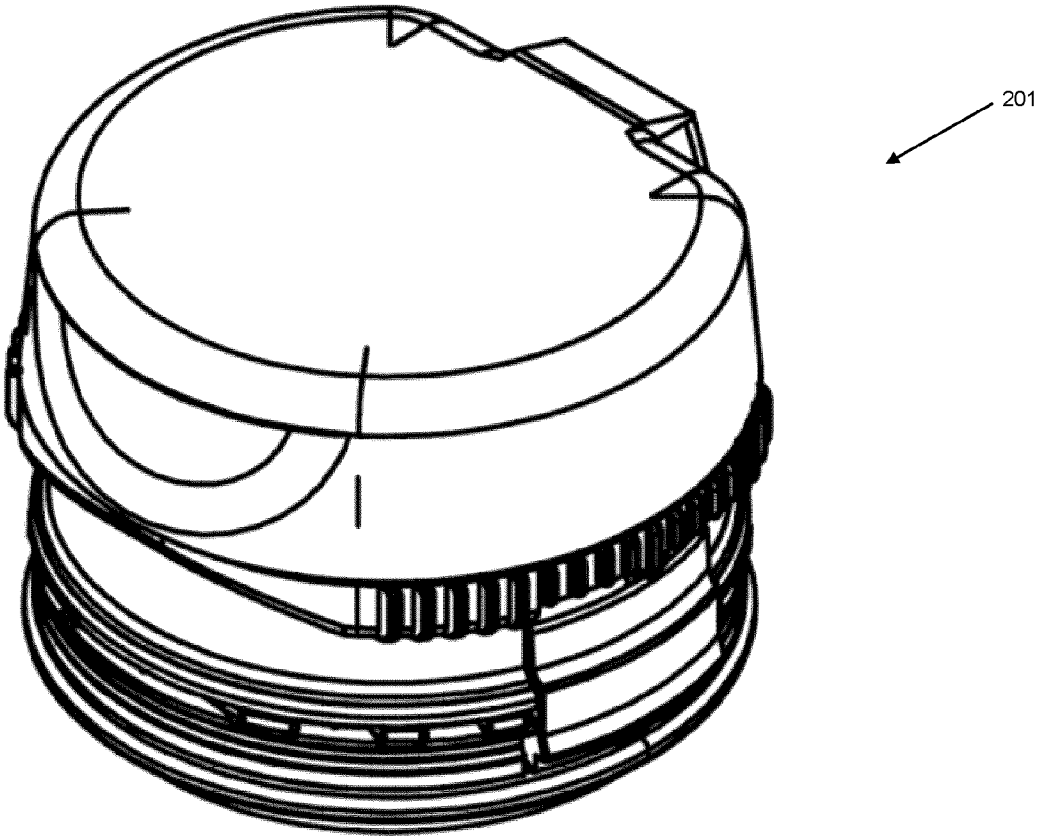
FIGS. 11 to 18 show perspective (closed), side (open), plan (closed), side (closed), front (closed), side (closed), section (along line A-A of FIG. 15), and section (along line B-B of FIG. 16) views.
Figure 12:
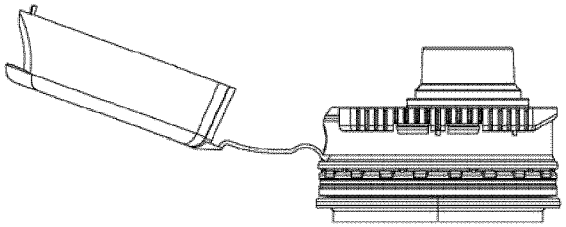
Figure 14:
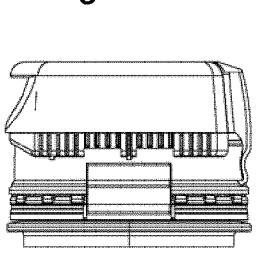
Figure 13:
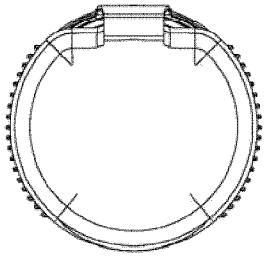
Figure 16:
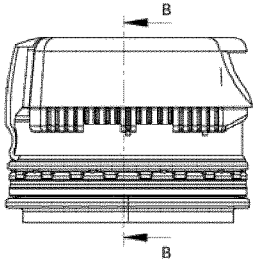
Figure 15:
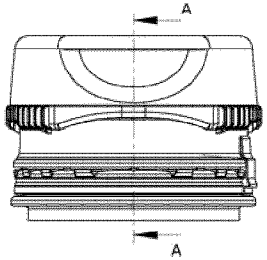
Figure 17:
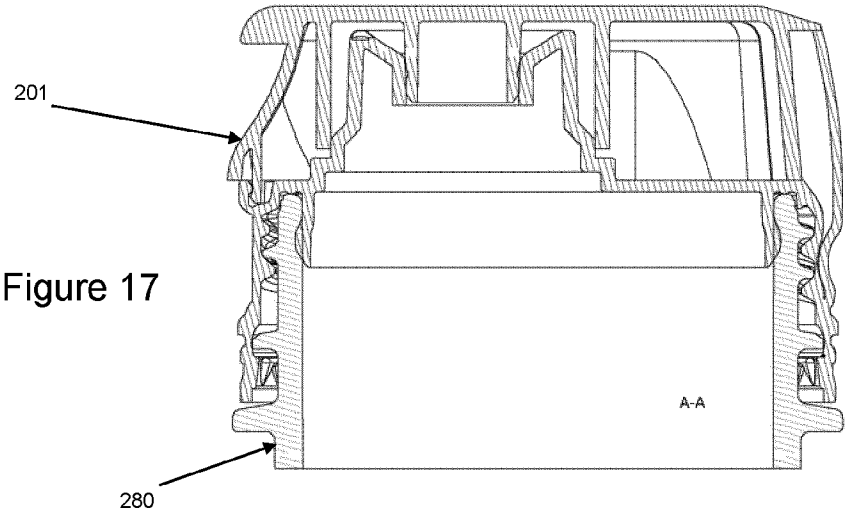
Figure 18:
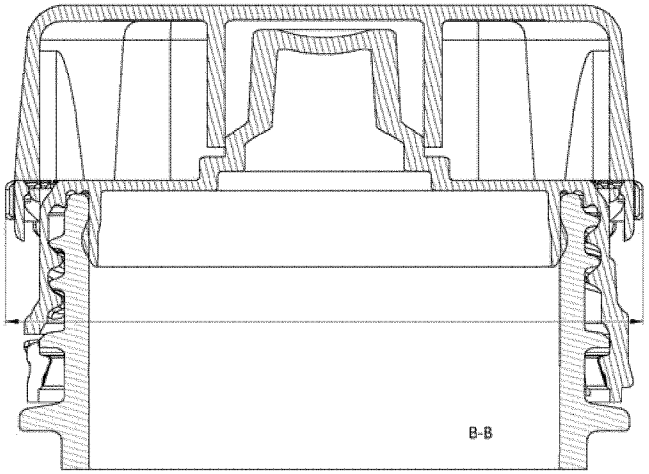

FIGS. 8 to 10 show a closure 101 formed according to a further embodiment.

In this embodiment additional hooking is provided at the front of the closure. The lid 150 includes a wall 170 that depends from the lid sidewall 154. The wall 170 terminates with a bead 171. The base 110 includes a corresponding wall III with a bead 113. When the lid is initially closed the beads 171, 113 engage. The lid cannot be opened without first deactivating the hooking provided by the beads. The hooking can be deactivated by pushing the lid sidewall beneath the peak as illustrated in FIG. 10. The hooking can be used to improve/increase sealing and resist unwanted opening of the lid e.g. if the closure is dropped.

FIGS. 11 to 18 show a closure 201 formed according to a further embodiment and shown attached to container neck 280. The closure 201 is similar to the closure 101.

Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention as defined by the appended claims and their equivalents.

The invention claimed is:

1. A tamper-evident closure comprising a base and a lid, the base comprises a sidewall, the base further comprises one or more outer wall portions which are radially outwards of the sidewall and extend partially around the sidewall, the closure comprises a tamper-evident member which is initially frangibly attached to the lid, wherein upon first opening of the lid the tamper-evident member is released from the lid and falls between the sidewall and one or more outer wall portions, wherein the one or more outer wall portions extends from the sidewall, with the sidewall and the outer wall portions forming a bifurcation, in section, at one end of the base, wherein in an initially unopened position, a tamper-evident member is hidden from view by the one or more outer wall portions, wherein upon first opening at least part of the tamper-evident member becomes visible, and wherein the one or more outer wall portions includes a window in which or through which the tamper-evident member can be seen after first opening, wherein the sidewall and the one or more outer wall portions terminate at approximately the same axial level.

2. The tamper-evident closure of claim 1, wherein the tamper-evident member engages with the one or more outer wall portions to cause release upon first opening.

3. The tamper-evident closure of claim 1, wherein the base includes a top deck and the sidewall depends from the periphery thereof.

4. The tamper-evident closure of claim 1, wherein the one or more outer wall portions are formed as an open valley.

5. The tamper-evident closure of claim 1, wherein the sidewall is generally cylindrical and the one or more outer wall portion s are formed concentrically therewith.

6. The tamper-evident closure of claim 1, wherein the closure has two outer wall portions that extend partially around the sidewall.

7. The tamper-evident closure of claim 6, wherein the two outer wall portions are diametrically opposite each other, and each outer wall portion directly engages a lower end of the lid when the lid is in the initially unopened position.

8. The tamper-evident closure of claim 1, wherein only one outer wall portion is provided, and the outer wall portion directly engages a lower end of the lid when the lid is in the initially unopened position.

9. The tamper-evident closure of claim 1, wherein the base and lid are joined by a hinge so that the lid can move between a closed and an open position.

10. The tamper-evident closure of claim 1, wherein the tamper-evident member is formed as a drop tab.

11. The tamper-evident closure of claim 1, wherein a plurality of outer wall portions and a plurality of tamper-evident members are provided.

12. The tamper-evident closure of claim 1, wherein the closure is formed as a mono-piece.

13. The tamper-evident closure of claim 1, wherein the lid includes a hooking arrangement for engaging the base and the hooking arrangement is offset circumferentially from the tamper evident member.

14. The tamper-evident closure of claim 13, wherein part of the lid is movable in a radially-inward direction to disengage the hooking arrangement so that the lid is free to move to the opened position.

15. The tamper-evident closure of claim 1, wherein the base includes a screw thread formation for engaging a container.

16. The tamper-evident closure of claim 1, wherein the base includes a snap bead for engaging a container.

17. The tamper-evident closure of claim 1, wherein the base comprises a retaining ring for retaining the closure on a container, the base includes a tether between the retaining ring and the sidewall.

18. The tamper-evident closure of claim 1, wherein the base comprises a dispensing spout.

19. The tamper-evident closure of claim 18, wherein the spout is eccentrically positioned on the base.

20. The tamper-evident closure of claim 19, wherein the base and the lid are connected at a rear of the closure by a hinge and the spout is positioned towards a front of the closure.

21. The tamper-evident closure of claim 18, wherein the spout has a height of approximately 8 mm.

22. The tamper-evident closure of claim 11, wherein two outer wall portions and a two tamper-evident members are provided and wherein a first pair of an outer wall portion and a tamper-evident member is diametrically opposite a second pair of an outer wall portion and a tamper-evident member.

23. The tamper-evident closure of claim 1 in combination with a container.

* * * * *